US007757505B2

(12) United States Patent
Sunderland

(10) Patent No.: US 7,757,505 B2
(45) Date of Patent: Jul. 20, 2010

(54) PREDICTIVE CAPACITY SYSTEMS AND METHODS FOR COMMERCIAL REFRIGERATION

(75) Inventor: Ted W. Sunderland, Troy, MO (US)

(73) Assignee: Hussmann Corporation, Bridgeton, MO (US)

( * ) Notice: Subject to any disclaimer, the term of this patent is extended or adjusted under 35 U.S.C. 154(b) by 930 days.

(21) Appl. No.: 11/592,282

(22) Filed: Nov. 2, 2006

(65) Prior Publication Data

US 2008/0104982 A1 May 8, 2008

(51) Int. Cl.
*F25B 1/00* (2006.01)
*F25B 49/00* (2006.01)

(52) U.S. Cl. ..... 62/228.1; 62/228.5; 62/155

(58) Field of Classification Search ..... 62/155, 62/157, 158, 228.1, 228.3, 228.4, 228.5
See application file for complete search history.

(56) References Cited

U.S. PATENT DOCUMENTS 4,951,475 A 8/1990 Alsenz
4,987,913 A 1/1991 Kodate et al.
5,493,867 A * 2/1996 Szynal et al. ..... 62/80
5,586,444 A 12/1996 Fung
6,321,543 B1 11/2001 Said et al.
6,332,327 B1 12/2001 Street et al.
6,419,454 B1 7/2002 Christiansen
6,591,620 B2 7/2003 Kikuchi et al.
6,644,398 B2 11/2003 Bujak, Jr.
6,647,735 B2 11/2003 Street et al.

* cited by examiner

*Primary Examiner*—Marc E Norman
(74) *Attorney, Agent, or Firm*—Michael Best & Friedrich LLP

(57) ABSTRACT

A system and method in a commercial refrigeration system for compensating for events. A commercial refrigeration system includes a controller that predicts a first change in cooling capacity required based on at least one anticipated system event. The controller also predicts a second change in cooling capacity required based on at least one anticipated system event during a period of time. The controller compares the first and second changes in cooling capacity and implements a change in cooling capacity based on a relationship between the first and second changes in cooling capacity.

20 Claims, 6 Drawing Sheets

PREDICTIVE CAPACITY SYSTEMS AND METHODS FOR COMMERCIAL REFRIGERATION

BACKGROUND

Control systems for commercial refrigeration systems generally control cooling capacity in response to variations in refrigeration load. Often this involves on/off control of fixed speed compressors and/or variable control of variable speed compressors. When multiple compressors in a parallel arrangement are used to provide refrigerant to multiple evaporators operating at varying temperatures, suction pressure is generally used as a control variable input to the control system. Often a controller, implementing a proportional-integral-derivative control algorithm, processes a sensed suction pressure common to all the compressors in the parallel arrangement and determines a control output for one or more compressors to maintain cooling capacity at a level that closely matches the refrigeration load presented by the evaporators.

SUMMARY

Events having a significant impact on a commercial refrigeration system (e.g., the beginning or end of a defrost cycle) can result in operational inefficiencies in the commercial refrigeration system due to delays between when an event occurs and when a controller detects and reacts to the event, as well as delays between when the controller implements a change and when the change actually impacts the system.

In addition, if events having opposite impacts occur sequentially, a commercial refrigeration system may take an action, based on a first event, only to reverse the action a short time thereafter, based on a second event.

In one embodiment, the invention provides a method of controlling a commercial refrigeration system having at least one compressor, evaporator, and controller. The method comprises the acts of calculating, by the controller, a control parameter necessary to correct a difference between a desired cooling capacity and a detected cooling capacity, predicting, by the controller, a first change in cooling capacity required by the commercial refrigeration system, predicting, by the controller, a second change in cooling capacity required by the commercial refrigeration system, comparing the first change in cooling capacity to the second change in cooling capacity, and implementing an actual change in cooling capacity based on a relationship between the first predicted change in cooling capacity and the second predicted change in cooling capacity.

The first predicted change in cooling capacity is based on at least one anticipated system event and a first latency parameter. The first latency parameter is substantially indicative of a first time period between a time at which a cooling capacity is changed at the compressor and a time at which an output of the at least one evaporator changes responsive to the change in cooling capacity at the compressor.

The second change in cooling capacity required by the commercial refrigeration system is based on the at least one anticipated system event and system events anticipated to occur during a second time period substantially immediately following the at least one anticipated system event.

In another embodiment, the invention provides a commercial refrigeration system. The system includes at least one condenser, at least one evaporator, at least one compressor, at least one expansion valve, and at least one controller. The at least one controller is configured to generate a control parameter for correcting a difference between a desired cooling capacity and a detected cooling capacity, to determine a first change in cooling capacity required as a result of at least one upcoming system event, and to modify an output of the at least one compressor. The controller modifies the output of the at least one compressor at a time prior to the system event occurring.

In another embodiment, the invention provides a commercial refrigeration system. The system includes at least one condenser, at least one evaporator, at least one compressor, at least one expansion valve, and at least one controller. The controller is configured to modify a cooling capacity based on the at least one evaporator beginning or ending a defrost cycle. The controller modifies the cooling capacity at a time prior to the beginning or ending of the defrost cycle. The controller changes the cooling capacity by an amount substantially equal to a change in system load resulting from the evaporator beginning or ending the defrost cycle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Although embodiments herein focus on commercial refrigeration systems, other embodiments can be implemented in non-commercial settings.

Embodiments of the invention relate to anticipating events in a commercial refrigeration system and proactively controlling the operation of the commercial refrigeration system to account for the anticipated events. In an embodiment of the invention, a controller anticipates one or more events (e.g., defrost cycles) in a commercial refrigeration system and modifies an output of a plurality of compressors to match an anticipated new demand.

Figure 1:
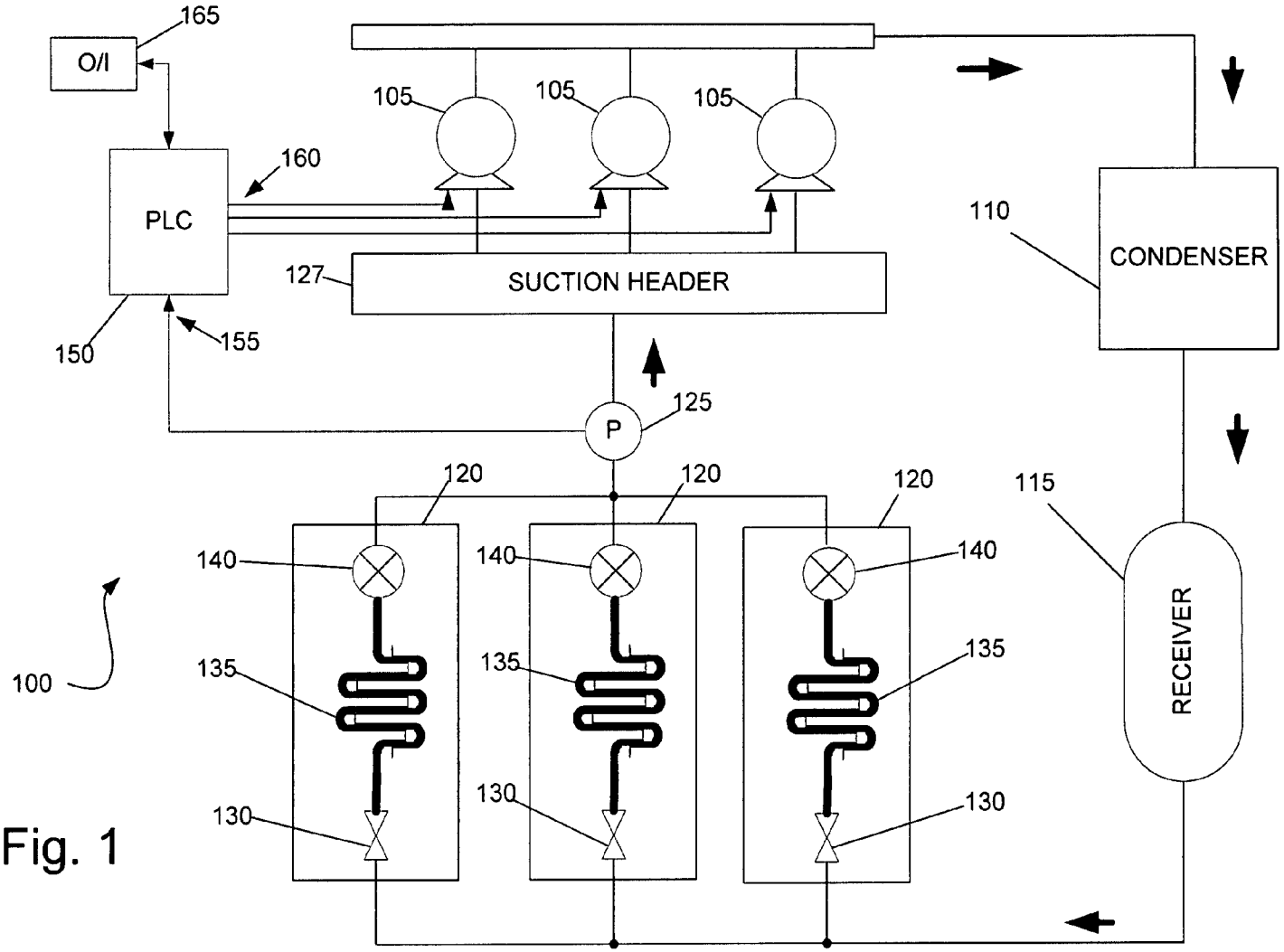
FIG. 1 is an illustration of a block diagram of an exemplary commercial refrigeration system.

FIG. 1 is a block diagram of an exemplary commercial refrigeration system 100. The commercial refrigeration system 100 includes at least one compressor 105, a condenser 110, a receiver 115, at least one display case 120, a pressure sensor 125, and a suction header 127. Each display case 120 includes an expansion valve 130, an evaporator 135, and a pressure regulator 140.

In the embodiment shown, the operation of the commercial refrigeration system 100 is controlled by a programmable logic controller ("PLC") 150 (e.g., a ControlLogix model manufactured by Rockwell Automation Allen-Bradley, Milwaukee, Wis.). The PLC 150 can include proportional-integral-derivative ("PID") control functionality.

The PLC 150 can include an analog input 155 which receives an indication of the suction pressure from a pressure sensor 125. The PLC 150 can also include outputs 160 for controlling each of the compressors 105. The PLC outputs can be digital outputs for controlling one or more fixed compressors (i.e., on or off) and/or can be analog outputs for controlling one or more variable compressors 105 (i.e., 0% to 100%).

The PLC 150 can also communicate with an operator interface 165 (e.g., a PanelView model manufactured by Rockwell Automation Allen-Bradley, Milwaukee, Wis.). The operator interface 165 can provide an operator with information on the operation of the commercial refrigeration system 100 and can enable the operator to enter and/or edit operating parameters (e.g., suction pressure set-point) in the commercial refrigeration system 100.

The compressor 105 compresses a refrigerant in the commercial refrigeration system 100 to provide cooling capacity for the system. In a commercial refrigeration system 100 with more than one compressor 105, the compressors 105 can turn on and off at the same or different times to meet the demand required by the system. In some embodiments, all of the compressors 105 are of one or more fixed capacities, and a control system stages the compressors into the system as necessary. In other embodiments, one or more of the compressors 105 has a variable capacity. As system demand changes, the output of the variable compressor 105 can be modified to meet the demand. When the variable compressor 105 is running at a predetermined threshold of its capacity (e.g., 85% or 15%), another compressor 105 can be staged in or out of the system, and the output of the variable compressor 105 modified, to meet the demand.

In each display case 120, the pressure of the refrigerant in the display case 120 is controlled by a respective pressure regulator 140. The pressure regulators 140 maintain the individual temperature set-points for each display case 120 by adjusting the pressure of the refrigerant in the evaporator 135 of the display case 120. To increase the temperature in the display case 120, the pressure regulator 140 can partially or completely close, increasing the pressure of the refrigerant in the evaporator 135. To reduce the temperature in the display case 120, the pressure regulator 140 can open to reduce the pressure of the refrigerant in the evaporator 135.

The pressure sensor 125 located in the common piping leading to the suction header 127 senses the pressure of the refrigerant before it enters the suction header. The sensed pressure is indicative of the maximum cooling capacity of the commercial refrigeration system 100. By running the compressors 105, such that the sensed suction pressure is at or below the pressure that corresponds to the lowest temperature set-point in the system, the system 100 can ensure that enough cooling capacity exists to meet the demands of the commercial refrigeration system 100.

The commercial refrigeration system 100 has delays, or latencies, which impact the ability of the controller 150 to control the system. For example, when a door of a display case 120 is opened, a temperature in the display case 120 can rise, requiring additional cooling capacity to maintain a desired temperature of the display case 120. The additional cooling capacity required results in an added load on the system 100. The added load is indicated in the system 100 by a rise in suction pressure at the suction header 127. The rise in suction pressure is detected by the controller 150 after a first delay or latency representative of the period of time it takes for the increase in load at the evaporator 135 to be detected by the controller 150 at the suction header 127.

The controller 150 then determines, based on the detected change in suction pressure, an amount by which to modify the output of the plurality of compressors 105 to meet the new demand level. The controller 150 then modifies its outputs to effect a change on the compressors 105 to meet the new demand level. A second delay or latency occurs as the compressors 105 implement the requested change. An output of a variable compressor can be modified to meet the new demand level or, using fixed compressors, changes in demand levels can be ignored until the new demand level is sufficiently different from the present capacity to warrant adding or subtracting a fixed compressor from a quantity of compressors presently operating.

A third delay or latency is equal to the period of time between when a change in cooling capacity is effected at the compressors 105 and when that change has an effect on the evaporators 135. In a commercial refrigeration system, the total of the three latencies can exceed several minutes (e.g., 3 to 10 minutes). Therefore, it can take several minutes to correct for an event that occurs. A fourth latency, equal to the first latency, occurs as the effected change travels from the evaporators 135 to the suction header 127 where it can be detected by the controller 150.

The impact of certain unanticipated events (e.g., briefly opening a display case door) is small, and a PID controller is generally able to control a commercial refrigeration system and maintain adequate cooling capacity. Other events, such as the beginning and end of defrost cycles, can have a more significant impact on the commercial refrigeration system. A typical commercial refrigeration system can require several defrost cycles each day to remove frost from its evaporators. In a large commercial refrigeration system, the defrost cycles can be staged, such that different evaporators are defrosted at different times. During a defrost cycle, a group of display cases, and their associated evaporators, are shut down, by closing their pressure regulators and stopping flow of refrigerant through the evaporators. This allows the evaporators to warm up and melt any frost that has formed on them. During this shut down, a total system load drops by an amount equal to the load of the display cases and associated evaporators that are shut down. Following a defrost cycle, the load of the display cases and associated evaporators is added back into the system. The size of this load change can be relatively significant. The latencies of the system, and the controller being optimized to handle the less significant, but more common events, such as a door of a display case opening for a short period, can result in inefficient operation of the commercial refrigeration system.

Figure 2:
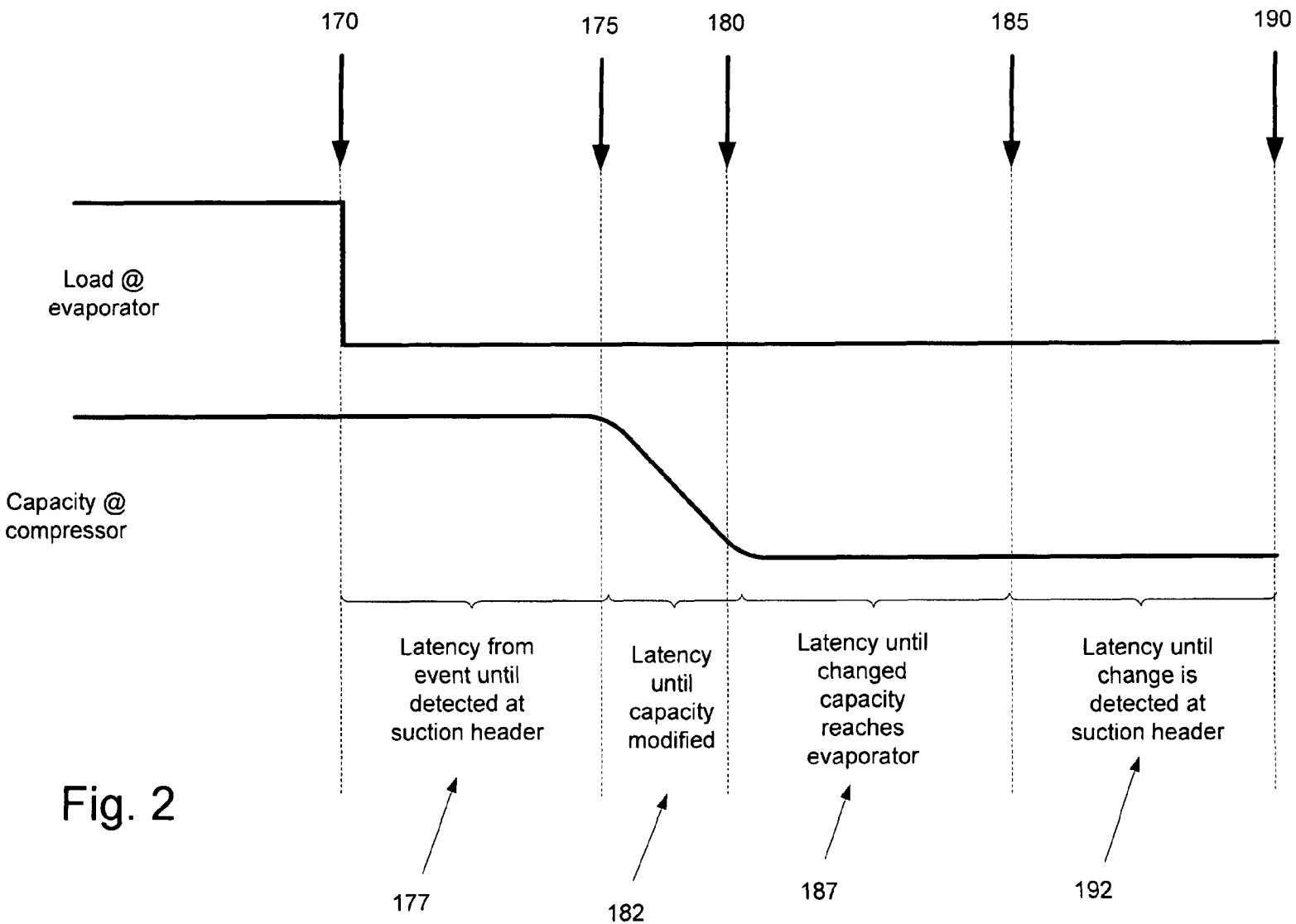
FIG. 2 is a graphic illustration of a timing relationship between a load and a cooling capacity in a commercial refrigeration system.

FIG. 2 graphically illustrates four latencies of a commercial refrigeration system. The upper graph illustrates a load required by the system (e.g., when a defrost cycle is beginning). The lower graph illustrates the cooling capacity at the compressors of the system as the controller reacts to the change in required load.

At a defrost start time ("dts") 170, the commercial refrigeration system enters a defrost cycle. At dts 170, the required load drops immediately as shown in the upper graph of FIG. 2. The commercial refrigeration system, however, does not respond immediately. Instead, the controller does not detect the change in suction pressure, indicative of the change in required load, until a second time 175. The time period between the dts 170 and the second time 175 is a first latency period 177.

The controller determines a level of correction necessary to match the cooling capacity to the required load (e.g., using PID functionality) and changes the cooling capacity accordingly. The compressors reach the new cooling capacity level at a third time 180. The time period between the second time 175 and the third time 180 is a second latency period 182.

The new cooling capacity then works its way through the system from the compressors to the evaporators, actually reaching the evaporators at a fourth time 185. The time period between the third time 180 and the fourth time 185 is the third latency period 187.

If the controller has accurately calculated the level of correction necessary, the load of the commercial refrigeration system is correct. However, the PID cannot determine whether the cooling capacity is correct until the new cooling capacity reaches the suction pressure sensor at a fifth time 190. The time period between the fourth time 185 and the fifth time 190 is a fourth latency period 192.

The fourth latency period 192 and the first latency period 177 both reflect the time period between when a change in load occurs at the evaporators and when that change is detected at the suction header. Therefore, the first and fourth latency periods 177 and 192 are equal.

In practice, a controller using a PID algorithm performs an iterative process and generally does not make the exact corrections necessary on its first attempt. Therefore, the time period from the defrost start time until the cooling capacity matches the required load is significantly longer than the sum of the first three latency periods 177, 182, and 187. The time period between an event occurring and the system making a proper correction is even longer because the controller is tuned to react to the less significant random events such as opening of a display case door. Further, if one group of display cases and associated evaporators is beginning a defrost cycle now and another group of display cases and associated evaporators is ending a defrost cycle in a short time, the commercial refrigeration system may turn off a compressor only to turn it back on shortly thereafter.

In some embodiments of the invention, the controller controls, or is at least aware of, the timing of scheduled events (e.g., defrost cycles, display case washing, condenser cleaning). The controller can be made aware of scheduled events by any suitable method, including programming (e.g., night setback, defrost start, defrost duration), sensing an input (e.g., a light sensor to determine periods of low or no light wherein an ambient temperature is lower, reducing a refrigeration load), and communications (e.g., modem or Internet).

The controller can use the knowledge of an upcoming event, and the latencies of the commercial refrigeration system, to make one or more adjustments (e.g., accelerate or feed forward the PID control), so that the cooling capacity of the system, dictated by the compressors, more precisely matches the load required at the evaporators.

In some embodiments, a commercial refrigeration system can have individual control systems for one or more of its functions (e.g., a compressor control, an evaporator control) instead of or in addition to a master controller. In such a distributed control environment, one controller (e.g., an evaporator controller) can inform another controller (e.g., a compressor controller) of parameters (e.g., dts, dte, dfl) of events occurring at the end of the impact latency period and during a window time period. In other embodiments, one controller (e.g., the compressor controller) can query other controllers (e.g., the evaporator controller) about parameters (e.g., dts, dte, dfl) of events that are scheduled to occur at the end of the first latency period and during a window time period.

Figure 3:
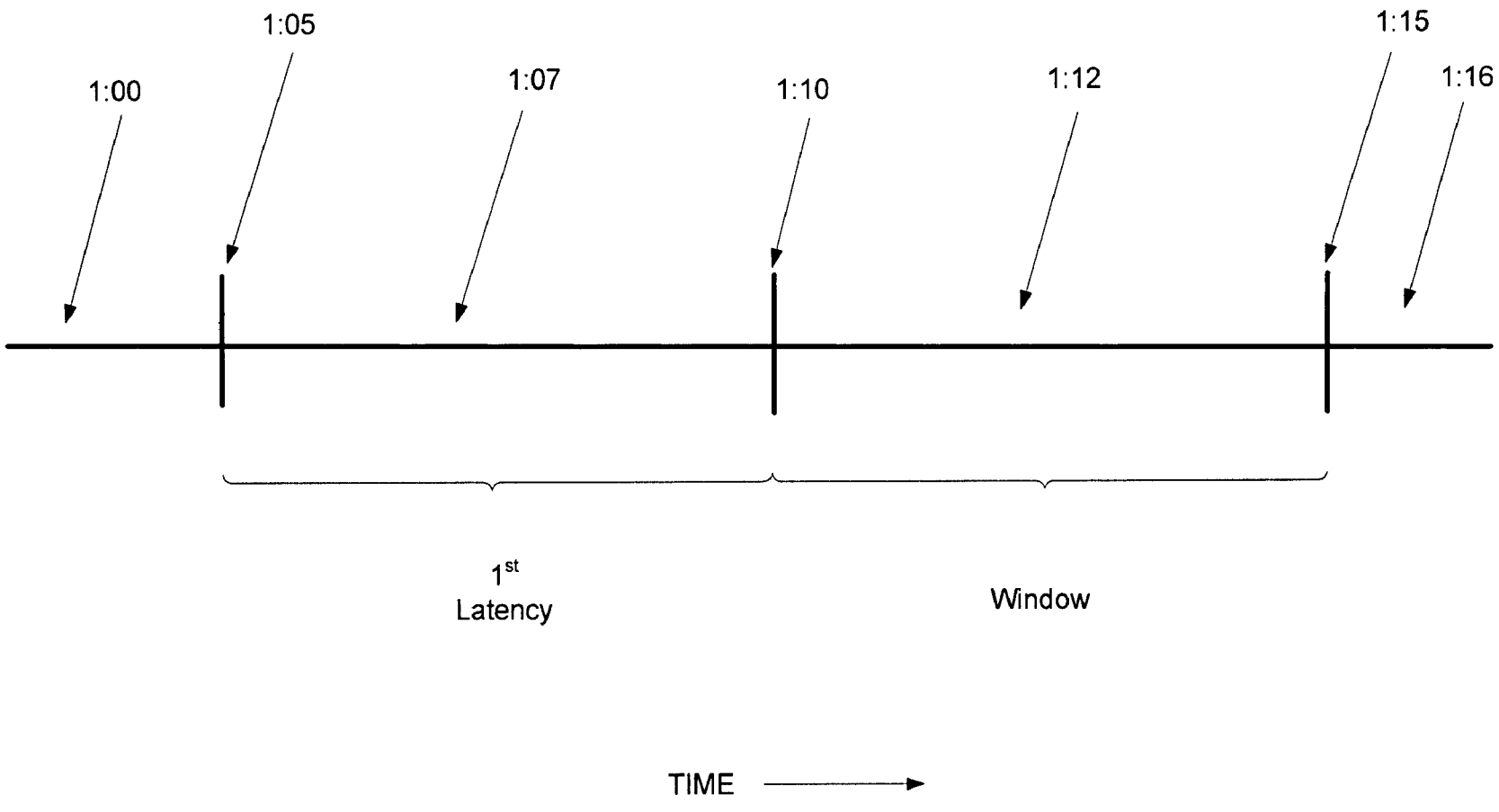
FIG. 3 illustrates an exemplary time line.

FIG. 3 is an exemplary time line to graphically illustrate different points in time when a controller of a predictive capacity system may make decisions. The present time of day ("TOD") is represented by the line at 1:05.

An impact latency period is the time period between when a change in cooling capacity is initiated at the compressors and when that change in cooling capacity has an effect on the evaporators. The impact latency period is equal to the sum of the second and third latency periods. In the example of FIG. 3, the impact latency period is arbitrarily set to five minutes. In an actual commercial refrigeration system, the impact latency period can be determined by measuring the time it takes for a change in compressor operation to have an effect on the evaporators. Since, in this example, the TOD is 1:05 and the impact latency period is five minutes, the end of the impact latency period is 1:10.

A window time period looks ahead to events that are scheduled to occur shortly after the events occurring at the end of the impact latency period. This window time period is used to prevent the institution of changes that will be reduced or eliminated as a result of events occurring in the near future. For example, a first group of display cases may be entering a defrost cycle, and a second group of display cases is set to exit a defrost cycle 30 seconds later. If the loads of the first and second groups of display cases are substantially equivalent, it would be undesirable to change the cooling capacity now (e.g., shut off a compressor) only to make an opposite change to the cooling capacity (e.g., start a compressor) 30 seconds later. Cycling a compressor in this manner can cause undue wear and tear and lead to premature failure of the compressor.

In the example of FIG. 3, the window time period is set at five minutes. The window time period can be set to any appropriate length and is generally related to a specific commercial refrigeration system. The window time period begins at the end of the impact latency period (e.g., 1:10) and ends five minutes later (e.g., 1:15). The controller anticipates events occurring at the end of the impact latency period, i.e., 1:10, and takes into account events occurring during the window time period, i.e., between 1:10 and 1:15 (e.g., an event occurring at 1:12). Events occurring during the window time period include events occurring at the end of the impact latency period. Any events occurring before the end of the impact latency period (e.g., 1:00 and 1:07) have already been anticipated and are ignored. Events occurring later than the end of the window time period (e.g., 1:16) are also ignored until such time as they are within the window time period.

Figure 4A:
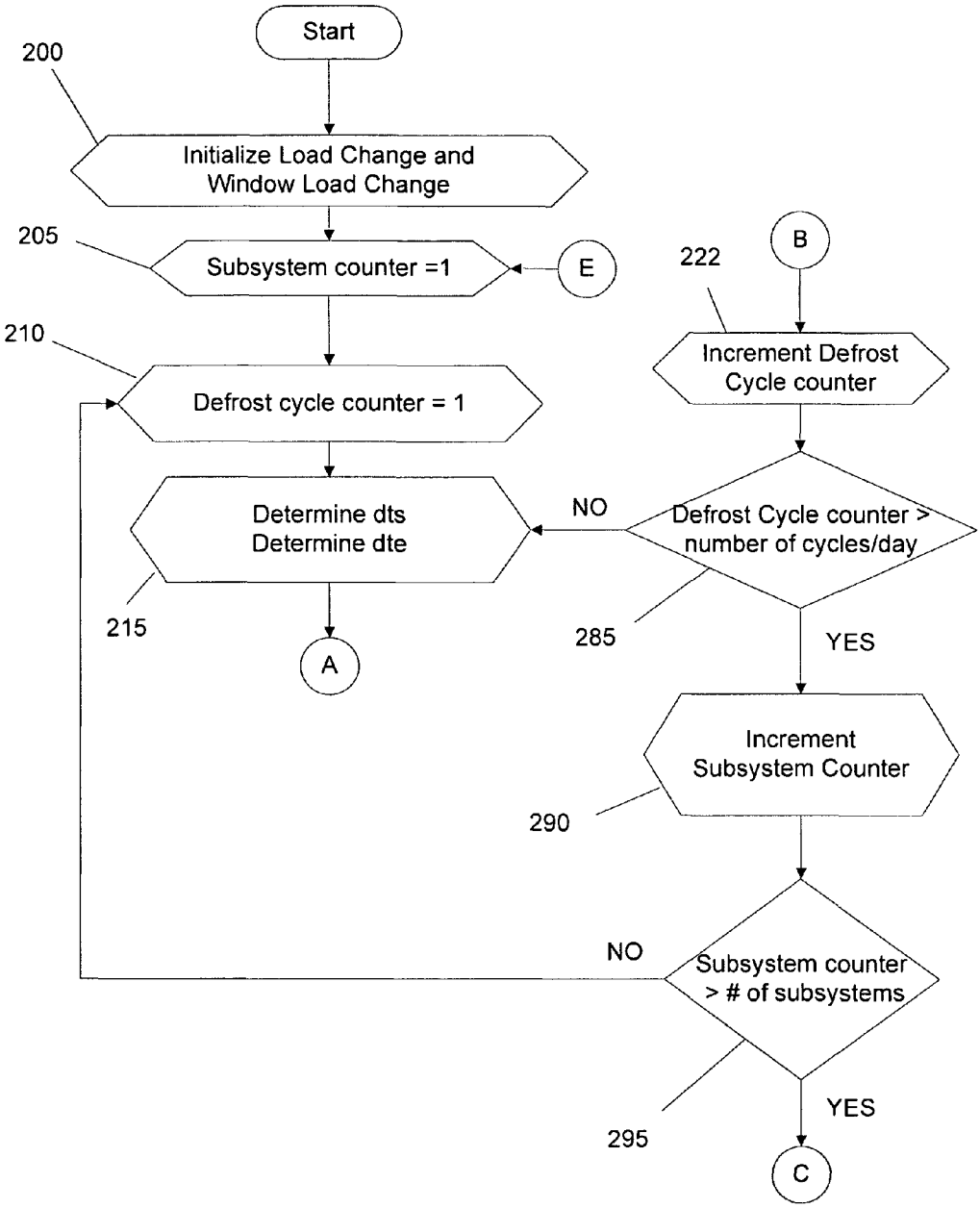
FIGS. 4A, 4B, and 4C are a flow chart of an embodiment of an operational process for predictively controlling a commercial refrigeration system.
Figure 4B:
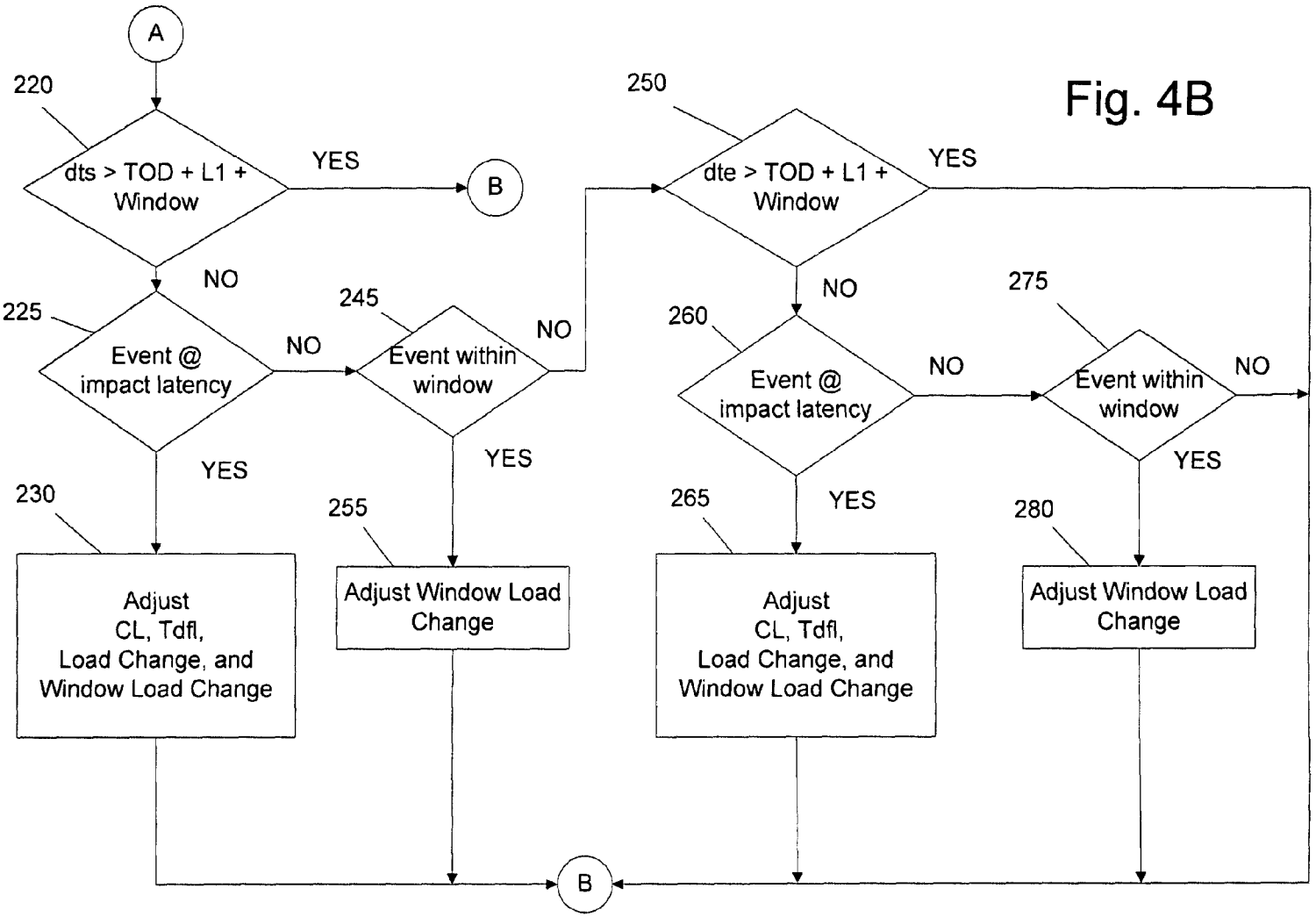
Figure 4C:
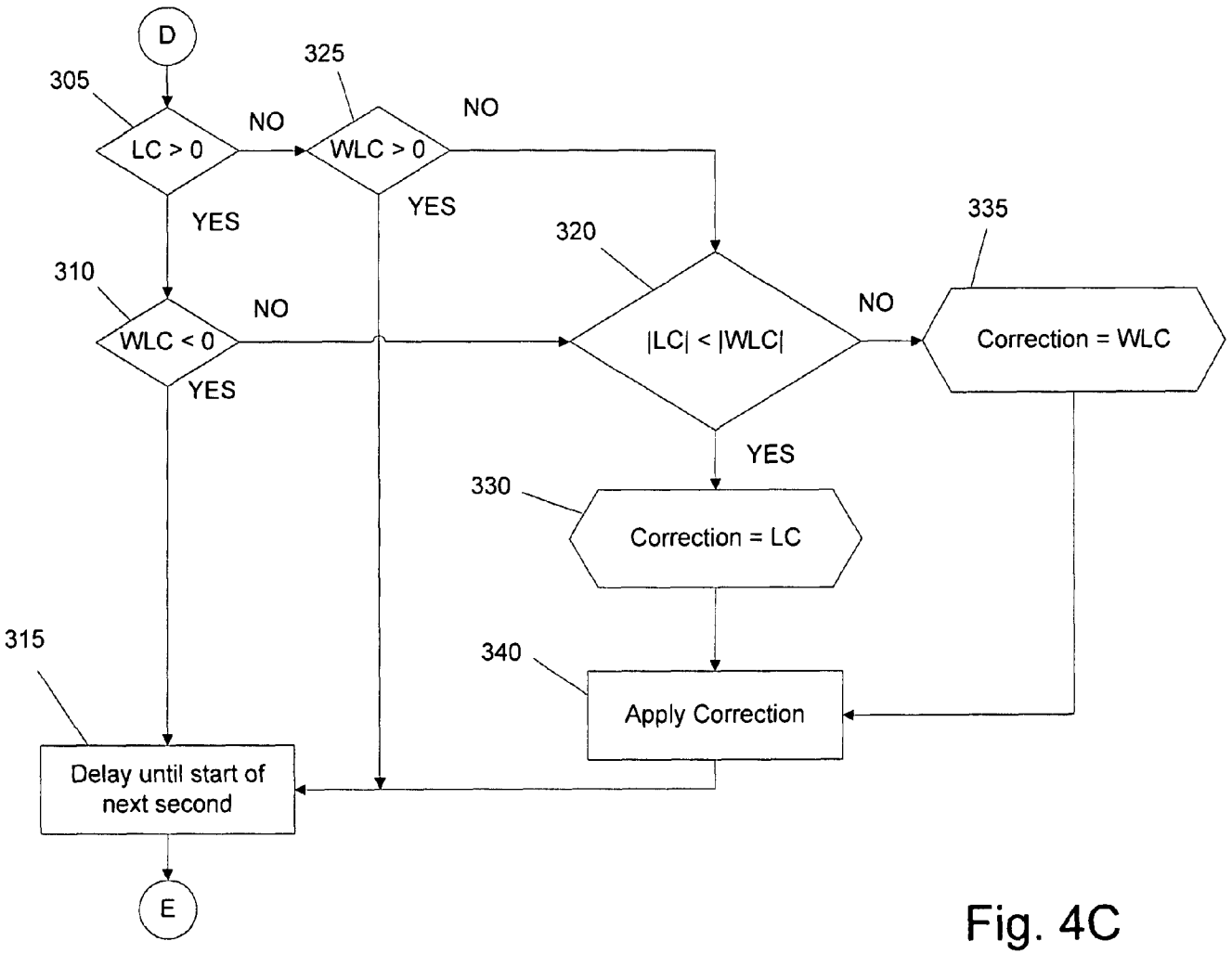

FIGS. 4A-4C illustrate an embodiment of an operational process for predictively controlling a commercial refrigeration system. The commercial refrigeration system can include a plurality of subsystems, each of which can include one or more display cases and one or more evaporators and can have one or more defrost cycles each day. Each defrost cycle has a defrost start time and a defrost length (or a defrost end time). In some embodiments, the controller maintains an array of defrost start times, defrost lengths, and defrost loads ("dfl") for each subsystem of the commercial refrigeration system. The controller also maintains, for each subsystem, a variable indicating the number of defrost cycles each day. The dfl is equal to the load removed from the commercial refrigeration system when the subsystem enters a defrost cycle (and the load added to the commercial refrigeration system when the subsystem exits a defrost cycle).

A controller of the commercial refrigeration system begins by setting a load change ("LC") variable and a window load change ("WLC") variable to zero (block 200). Next, the controller sets a subsystem counter to one (block 205) and a defrost cycle counter to one (block 210).

At block 215, the controller reads, from the array a dts for a particular subsystem for a particular defrost cycle. The controller also reads from the array a defrost length for the subsystem and defrost cycle and calculates a defrost end time ("dte"), based on the dts and the defrost length.

At block 220, the controller compares the dts to the sum of the TOD, the impact latency period, and the window time period. If the dts is later than the end of the window time period, the controller continues processing at block 222 as described below. If the dts is prior to the end of the window time period (e.g., any time prior to 1:15 in FIG. 3), the controller checks if the defrost cycle is scheduled to happen in a time period equal to the impact latency (block 225). If the event is scheduled to happen in a time period equal to the impact latency (e.g., 1:10 in FIG. 3), the controller continues processing at block 230 by adjusting the LC, WLC, and a current load variable ("CL") down by an amount equal to the dfl. The controller also adjusts a total defrost load variable ("Tdfl") up by the same amount to reflect the total of the loads of all the subsystems in a defrost cycle. The controller then continues processing at block 222.

If, at block 225, the event was not scheduled to occur in a time period equal to the impact latency, the controller checks whether the event has already been anticipated (block 245) (e.g., anytime prior to 1:10 in FIG. 3). If the event has already been anticipated, the controller continues processing at block 250. If not, the time for adjustment has not arrived, and the event is scheduled during the window time period (e.g., between 1:10 and 1:15 in FIG. 3). The controller then adjusts the WLC down by the dfl of the subsystem (block 255) and continues processing at block 222.

At block 250, the controller compares the dte to the sum of the TOD, the impact latency period, and the window time period. If the dte is later than the end of the window time period, the controller continues processing at block 222 as described below.

If the dte is prior to the end of the window time period (e.g., anytime prior to 1:15 in FIG. 3), the controller checks if the event is scheduled to happen in a time period equal to the impact latency (block 260). If the event is scheduled to happen in a time period equal to the impact latency (e.g., 1:10 in FIG. 3), the controller continues processing at block 265 by adjusting the LC, WLC, and CL up by an amount equal to the dfl. The controller also adjusts the total Tdfl down by the same amount to reflect the total of the loads of all the subsystems in a defrost cycle. The controller then continues processing at block 222 as described below.

If, at block 260, the event was not scheduled to occur in a time period equal to the impact latency, the controller checks whether the event has already been anticipated (block 275) (e.g., anytime prior to 1:10 in FIG. 3). If the event has already been anticipated, the controller continues processing at block 222 as described below. If not, the time for adjustment has not arrived, and the commercial refrigeration system is in the window time period (e.g., between 1:10 and 1:15 in FIG. 3). The controller adjusts the WLC up by the dfl of the subsystem (block 280) and continues processing at block 222.

Processing continues at block 222 with the defrost cycle counter being incremented. The controller determines, at block 285, if all the defrost cycles for this subsystem have been checked. If all of the defrost cycles for this subsystem have not been checked, the controller checks the next defrost cycle beginning at block 215 with obtaining the dts and dte.

If all of the defrost cycles for this subsystem have been checked, the controller increments the subsystem counter (block 290) and checks if all of the subsystems have been checked (block 295). If not all of the subsystems have been checked, the next subsystem is checked starting at block 210.

If all of the defrost cycles for all of the subsystems have been checked, the controller continues at block 300 with displaying the adjusted CL and Tdfl.

Next, the controller checks if the LC is greater than zero (block 305). If the LC is greater than zero, the controller checks if the WLC is less than zero (block 310). If the LC is greater than zero and the WLC is less than zero, there is a need for greater cooling capacity at the end of the impact latency period due to the total load of the subsystems ending defrost cycles at that time being greater than the total load of the subsystems beginning defrost cycles at that time. In some embodiments, the controller can add cooling capacity in anticipation of the greater load. However, since the WLC, including the loads changing at the end of the impact latency period, is less than zero, the total load of the subsystems beginning defrost cycles during the window time period is greater than the total load of the subsystems ending defrost cycles during the window time period. Therefore, cooling capacity would be added now and removed at one or more times during the window time period. This may result in the cycling of one or more compressors. Since the subsystem load of the commercial refrigeration system will rise at the end of the impact latency period, but drop before the window ends, the controller does not adjust the cooling capacity and continues at block 315, waiting for the next processing window to start (e.g., on the next second).

If, at block 310, the WLC was not less than zero, there is a need for greater cooling capacity both at the end of the impact latency period and during the window time period. The controller then continues processing at block 320 as will be explained below.

If, at block 305, the LC was not greater than zero, the controller checks if the WLC is greater than zero (block 325). If the LC is not greater than zero and the WLC is greater than zero, there is a need for less cooling capacity at the end of the impact latency period due to the total load of the subsystems beginning defrost cycles at that time being greater than the total load of the subsystems ending defrost cycles at that time. In some embodiments, the controller can reduce cooling capacity in anticipation of the lesser load. However, since the WLC, including the loads changing at the end of the impact latency period, is greater than zero, the total load of the subsystems ending defrost cycles during the window time period is greater than the total load of subsystems beginning defrost cycles during the window time period. Therefore, in the simple predictive system, cooling capacity would be reduced now and added at one or more times during the window time period, possibly resulting in the cycling of one or more compressors. Since the subsystem load of the commercial refrigeration system will drop at the end of the impact latency period but rise before the window ends, the controller does not adjust the cooling capacity and continues at block 315, waiting for the next processing window to start (e.g., on the next second).

If, at block 325, the WLC was not greater than zero, there is a need for less cooling capacity both at the end of the impact latency period and during the window time period.

At block 320, the controller compares the absolute value of the load change to the absolute value of the window load change, to determine whether the magnitude of the load change occurring at the end of the impact latency period is less than the magnitude of the load change occurring during the window time period. If the magnitude of the load change at the end of the impact latency period is less than the magnitude of the load change during the window time period, the controller sets the correction value to the load change occurring at the end of the impact latency period (block 330). If the magnitude of the load change at the end of the impact latency period is not less than the magnitude of the load change during the window time period, the controller sets the correction value to the load change during the window time period (block 335). This prevents the controller from making a large adjustment now and reversing some or all of the adjustment a short time later.

Next, at block 340, the correction is applied to the commercial refrigeration system. Following application of the correction, the controller waits at block 315 for the next processing window to start (e.g., at the start of the next second).

Applying the correction at block 340 is application specific and can include applying a feed forward value to a PID control, applying an offset to a control variable output of a PID, directly adding/subtracting a compressor to/from the system, and directly adjusting an output of a variable compressor.

Various features and advantages of the invention are set forth in the following claims.

The invention claimed is:

1. A method of controlling a commercial refrigeration system having at least one compressor, evaporator, and controller, the method comprising:

calculating, by the controller, a control parameter necessary to correct a difference between a desired cooling capacity and a detected cooling capacity;

predicting, by the controller, a first change in cooling capacity required by the commercial refrigeration system based on at least one anticipated system event and a first latency parameter, the first latency parameter substantially indicative of a first time period between a time at which a cooling capacity is changed at the compressor and a time at which an output of the at least one evaporator changes responsive to the change in cooling capacity at the compressor;

predicting, by the controller, a second change in cooling capacity required by the commercial refrigeration system based on the at least one anticipated system event and system events anticipated to occur during a second time period substantially immediately following the at least one anticipated system event;

comparing the first change in cooling capacity to the second change in cooling capacity; and implementing an actual change in cooling capacity based on a relationship between the first predicted change in cooling capacity and the second predicted change in cooling capacity.

2. The method of claim 1, wherein the change in cooling capacity is implemented at a time prior to the anticipated event, the time substantially equal to a time when the first anticipated event is scheduled to occur minus the first latency parameter.

3. The method of claim 1, wherein the controller includes a proportional-integral-derivative controller.

4. The method of claim 1, wherein the actual change in cooling capacity is implemented in a feed forward function of a proportional-integral-derivative controller.

5. The method of claim 1, and further comprising implementing no change in cooling capacity when the first change in cooling capacity is positive and the second change in cooling capacity is negative.

6. The method of claim 1, and further comprising implementing no change in cooling capacity when the first change in cooling capacity is negative and the second change in cooling capacity is positive.

7. The method of claim 1, wherein implementing the change in cooling capacity includes adjusting an output of a variable compressor.

8. The method of claim 1, wherein the actual change in cooling capacity is equal to the first change in cooling capacity when an absolute value of the first change in cooling capacity is less than an absolute value of the second change in cooling capacity.

9. The method of claim 1, wherein the actual change in cooling capacity is equal to the second change in cooling capacity when an absolute value of the second change in cooling capacity is less than an absolute value of the first change in cooling capacity.

10. The method of claim 1, wherein the actual change in cooling capacity adds or subtracts a fixed compressor when the actual change in cooling capacity exceeds a threshold.

11. A commercial refrigeration system, the system comprising:

at least one condenser;

at least one evaporator;

at least one compressor;

at least one expansion valve; and at least one controller configured to generate a control parameter for correcting a difference between a desired cooling capacity and a detected cooling capacity, to determine a first change in cooling capacity required as a result of at least one upcoming system event, and to modify an output of the at least one compressor, wherein the controller modifies the output of the at least one compressor at a time prior to the system event occurring.

12. The system of claim 11, wherein the controller determines the time to modify the output of the at least one compressor such that the output of the at least one evaporator is responsive to the change in the output of the at least one compressor at a time substantially the same as a time the system event occurs.

13. The system of claim 11, wherein the controller determines a second change in cooling capacity required as a result of the at least one upcoming system event and any system events scheduled to occur within a period of time following the time at which the upcoming system event is scheduled to occur.

14. The system of claim 13, wherein the controller determines a change in cooling capacity based on a relationship between the first change in cooling capacity and the second change in cooling capacity.

15. The system of claim 14, wherein the controller adds or subtracts a fixed compressor based on a relationship between the change in cooling capacity and the control parameter.

16. A commercial refrigeration system, the system comprising:

at least one condenser;

at least one evaporator;

at least one compressor;

at least one expansion valve; and at least one controller configured to modify a cooling capacity based on the at least one evaporator beginning or ending a defrost cycle, the controller modifying the cooling capacity at a time prior to the beginning or ending of the defrost cycle, the controller changing the cooling capacity by an amount substantially equal to a change in system load resulting from the evaporator beginning or ending the defrost cycle.

17. The system of claim 16, wherein the controller determines the time to modify the cooling capacity such that the at least one evaporator is responsive to the change in cooling capacity at a time substantially the same as a time at which the defrost cycle begins or ends.

18. The system of claim 16, wherein the controller determines a second change in cooling capacity required as a result of the defrost cycle and system events scheduled to occur within a period of time following the time at which the defrost cycle is scheduled to begin or end.

19. The system of claim 18, wherein the controller determines a change in cooling capacity based on a relationship between the change in cooling capacity substantially equal to the change in system load resulting from the evaporator beginning or ending the defrost cycle and the second change in cooling capacity.

20. The system of claim 19, wherein the controller adds or subtracts a fixed compressor based on a relationship between the change in cooling capacity and the control parameter.

* * * * *